US008176858B2

(12) United States Patent
Leng

(10) Patent No.: US 8,176,858 B2
(45) Date of Patent: May 15, 2012

(54) COMPOSITE DESK

(75) Inventor: Luhao Leng, Fujian (CN)

(73) Assignee: New-Tec Integration (Xiamen) Co., Ltd., Xiamen (CN)

( * ) Notice: Subject to any disclaimer, the term of this patent is extended or adjusted under 35 U.S.C. 154(b) by 545 days.

(21) Appl. No.: 11/661,909

(22) PCT Filed: Sep. 7, 2004

(86) PCT No.: PCT/CN2004/001023
§ 371 (c)(1),
(2), (4) Date: Mar. 2, 2007

(87) PCT Pub. No.: WO2005/096883
PCT Pub. Date: Oct. 20, 2005

(65) Prior Publication Data

US 2009/0117318 A1 May 7, 2009

(30) Foreign Application Priority Data

Apr. 6, 2004 (CN) ..... 2004 2 0039919

(51) Int. Cl.
*A47B 96/14* (2006.01)

(52) U.S. Cl. ..... 108/193; 108/161; 108/157.14

(58) Field of Classification Search ..... 108/147.16, 108/50.01, 50.02, 193, 51.3, 131, 129, 132, 108/161, 153.1, 157.14, 27; 312/195, 223.3, 312/263, 404, 194; 248/220.31, 220.21, 248/220.22, 222.11, 231.81; 52/783.1; 428/73, 428/52, 53
See application file for complete search history.

(56) References Cited

U.S. PATENT DOCUMENTS

| | | | | | |
|---|---|---|---|---|---|
| 1,641,055 | A | * | 8/1927 | Schmitt | 108/161 |
| 2,341,125 | A | * | 2/1944 | Spear | 312/236 |
| 3,192,884 | A | * | 7/1965 | Hamilton et al. | 108/92 |
| 3,338,647 | A | * | 8/1967 | Schreyer | 312/194 |
| 3,359,930 | A | * | 12/1967 | Schreyer | 108/92 |
| 3,363,955 | A | * | 1/1968 | Schreyer | 312/194 |
| 3,366,431 | A | * | 1/1968 | Hanson | 312/208.1 |
| 3,385,642 | A | * | 5/1968 | Schreyer | 312/195 |
| 3,434,768 | A | * | 3/1969 | Schreyer | 312/194 |
| 3,450,296 | A | * | 6/1969 | Schreyer | 220/532 |
| 3,471,211 | A | * | 10/1969 | Schreyer | 312/330.1 |
| 3,521,935 | A | * | 7/1970 | Studinski et al. | 312/194 |
| 3,541,256 | A | * | 11/1970 | Anders | 348/150 |
| 3,554,624 | A | * | 1/1971 | Schreyer | 312/194 |
| 3,572,869 | A | * | 3/1971 | Studinski et al. | 312/194 |
| 3,676,279 | A | * | 7/1972 | Beaver | 428/73 |
| 3,835,795 | A | * | 9/1974 | Levenberg | 108/153.1 |
| 4,223,945 | A | * | 9/1980 | Nikitits | 297/158.4 |
| 4,423,978 | A | * | 1/1984 | Tiegelmann | 403/254 |
| 4,689,257 | A | * | 8/1987 | Baum | 428/106 |
| 4,886,326 | A | * | 12/1989 | Kuzyk | 312/257.1 |
| 5,011,228 | A | * | 4/1991 | Marcantel | 297/440.13 |
| 5,094,174 | A | * | 3/1992 | Grund et al. | 108/153.1 |

(Continued)

*Primary Examiner* — Jose V Chen
(74) *Attorney, Agent, or Firm* — W. F. Fasse

(57) ABSTRACT

A composite desk, including: two desk sideboards and a desk top, the two desk sideboards support the desk top, the desk sideboards and the desk top are made of the plastic composite board completely or partially; the plastic composite board includes a top board; a bottom board; a honeycomb board and a liner part, the honeycomb board is stuffed between the top board and the bottom board, the liner part is disposed between the top board and the bottom board, the liner part entirely or partly wraps the honeycomb board along the sides of the honeycomb board; the connection between the desk sideboard and the desk top is hanging connection.

18 Claims, 7 Drawing Sheets

U.S. PATENT DOCUMENTS 5,335,605 A * 8/1994 Drabczyk ..... 108/153.1
5,565,263 A * 10/1996 Ohsumi et al. ..... 442/376
5,613,746 A * 3/1997 Green et al. ..... 312/194
5,653,550 A * 8/1997 Mutz et al. ..... 403/329
5,694,865 A * 12/1997 Raab ..... 108/161
5,732,637 A * 3/1998 Raab ..... 108/129
5,753,340 A * 5/1998 Welch et al. ..... 428/117
5,804,278 A * 9/1998 Pike ..... 428/116
5,868,081 A * 2/1999 Raab ..... 108/161
5,894,044 A * 4/1999 Norcom et al. ..... 428/116
5,947,037 A * 9/1999 Hornberger et al. ..... 108/115
6,090,464 A * 7/2000 Yoo ..... 428/73
6,231,947 B1 * 5/2001 Hill ..... 428/120
6,368,009 B1 * 4/2002 Noda ..... 403/329
6,659,023 B2 * 12/2003 Saltzman et al. ..... 108/161
6,837,171 B1 * 1/2005 Clark et al. ..... 108/131
2003/0087079 A1 * 5/2003 Okabe et al. ..... 428/304.4
2004/0200571 A1 * 10/2004 Yamaguchi et al. ..... 156/292

* cited by examiner

COMPOSITE DESK

FIELD OF THE INVENTION

The invention relates a composite desk, more particularly, to a composite desk composed of several plastic composite plates, which are connected with each other through hanging connection.

BACKGROUND OF THE INVENTION

Desks are of practicability, so they are widely used in offices and homes. The desks are made of wood in the past. As people attach more importance to ecological environment, the wood acquired from deforestation is replaced by a plastic board. The existing desk which is made of plastic boards, a reinforcing steel beam is fixed on the bottom-surface of desk top, the upper end of the desk leg is connected with a reinforcing steel beam. The drawbacks of said desk are as following: 1. A reinforcing steel beam is fixed on the bottom surface of desk top, so it is a waste of material, and the cost of manufacture is high, the weight of desk top is increased; 2. the desk top is hollow, so its intensity is weak; 3. the upper end of the desk leg is connected with the reinforcing steel beam, the connecting strength is weak, and the connection structure is not removable.

SUMMARY OF THE INVENTION

The aim of the present invention is to resolve the drawbacks of the existing technology, and provide a composite desk which has high connecting strength, removable and convenient connection.

The technical project according to the invention is: a composite desk, comprising: two desk sideboards and a desk top, said two desk sideboards support the desk top, said desk sideboards and the desk top are made of the plastic composite board completely or partially. The plastic composite board includes a top board; a bottom board; a honeycomb board and a liner part, the honeycomb board is stuffed between the top board and the bottom board, the liner part is disposed between the top board and the bottom board, said liner part entirely or partly wraps the honeycomb board along the sides of the honeycomb board; the connection between desk sideboard and desk top is hanging connection. The composite desk of this invention adopts the plastic composite board, which has high intensity and light weight; the connection between desk sideboard and the desk top is hanging connection or screw thread connection, which has high connecting strength and security; the hanging connection is removable, it can occupy less space when is stored or conveyed; the plastic composite board comprises a top board; a bottom board; a honeycomb board and a liner part, said plastic composite board has high intensity and light weight.

Said desk according to this invention comprises the front baffle, which is positioned between the desk sideboards and connected to same. The connection between desk sideboard and the front baffle is hanging connection or screw thread connection. Said connection has high connecting strength and security; the hanging connection is removable, it can occupy less space when is stored or conveyed.

The desk top, the front baffle and the two desk sideboards are made of the plastic composite board, said every two composite boards which are connected with each other through hanging connection, the first plastic composite board where the reinforcement is fixed, a clasp groove exposed outside the first plastic composite board is provided in the said reinforcement; the second plastic composite board where the reinforcement is fixed, a clasp extended out of the second plastic composite board is provided in the said reinforcement; the first plastic composite board is connected with the second plastic composite board through the connection between the clasp and the clasp groove. The desk top, front baffle and two desk sideboards of the invention are plastic composite board, which has high intensity and light weight, specially, the desk top can hold the high pressure. The reinforcement is disposed in the plastic composite board, so the appearance is good, it is easy for processing, and the reinforcement does not hurt people or scratch clothes; the first plastic composite board is connected with the second plastic composite board through the connection between the clasp and the clasp groove, the connection has high connecting strength and security; the reinforcement is disposed in the first plastic composite board, the clasp groove is provided in the said reinforcement, which is easy for processing and has no influence to the intensity of the first plastic composite board, the reinforcement is disposed in the second plastic composite board, the clasp is provided in the said reinforcement, the connecting strength between the clasp and reinforcement is high, and has no influence to the intensity of the second plastic composite board.

The desk top, a front baffle and two desk sideboards are partly made of the plastic composite board, the reinforcement is disposed in the plastic composite board, a clasp groove exposed outside the first plastic composite board or a clasp extended out of the second plastic composite board is provided in the said reinforcement; the corresponding clasp or clasp groove is provided on the other boards; the connections among the desk sideboards, the desk top, the front baffle are realized through the connection between the clasp and the clasp groove.

The top board and the bottom board of the plastic composite board are made of the plastic board, which is processed by means of vacuum forming technology, said plastic composite board comprises reinforcements, liner parts, honeycomb paper cores, honeycomb plastic cores, foaming fillers, which are disposed in the plastic composite board. The plastic composite board according to this invention has a good appearance, high intensity and light weight, and the process cost is low.

The top board and the bottom board of the plastic composite board are made of the plastic sheet, the sides of the top board and the bottom board are wrapped with edge strips, said plastic composite board comprises reinforcements, liner parts, honeycomb paper cores, honeycomb plastic cores, foaming fillers, which are disposed in the plastic composite board. The plastic composite board according to this invention has a good appearance, high intensity and light weight, and the process cost is low.

The top board and the bottom board of the plastic composite board are made of singlelayer or multiplelayer plastic board, which is processed by means of vacuum forming technology or machining process directly, the thickness of the plastic board is 0.3 mm~4 mm. The plastic composite board according to this invention has a good appearance, high intensity and light weight, and the process cost is low.

The surfaces of the top board and the bottom board of the plastic composite board are covered by printing layer or membrane, which has timber grain or natural color of marble. The surfaces of the top board and the bottom board of the plastic composite board are covered by printing layer or membrane, it has a good appearance, and easy for manufacture.

The reinforcement disposed in the plastic composite board of this invention is made of tubular material or section material injection moulding material or metal composite. The said reinforcement is made of tubular material or section material injection moulding material or metal composite, which is easy for manufacture, convenient for connection, the cost is low, the connecting strength is high.

The clasp of this invention is a plastic clasp or L-shaped sheet metal, L-shaped sheet, ⊔-shaped dowel pin. The said clasp groove is rectangular or elliptic, ⊔-shaped, and the structure of clasp corresponds to the structure of the clasp groove. The clasp of this invention is a plastic clasp or L-shaped sheet metal, L-shaped sheet, ⊔-shaped dowel pin, it has low cost, easy for manufacture, security connection, the structure of clasp corresponds to the structure of the clasp groove, the connection is security and the connecting strength is high.

The clasp of the second plastic composite board is connected with the reinforcement disposed in the second plastic composite board by means of welding, riveted connection or screw thread connection. The connection between clasp and the reinforcement is welding connection, riveted connection or screw thread connection. The said connection has high intensity.

The connection between the first plastic composite and the second plastic composite is L-shaped or T-shaped, —-shaped. The said connection has high connecting strength.

As the description above, compared with background technology, the advantages of this invention are as following: 1. the composite desk according to this invention has high intensity and light weight; 2. the connecting strength of the connection between plastic composite boards according to this invention is high, the connection between plastic composite boards is convenient. 3. the plastic composite boards according to this invention have high intensity; 4. the reinforcements are disposed in the plastic composite boards, so the appearance is good and it is easy for manufacture, and the reinforcements can not hurt people or scratch the cloth, it is safe to use. 5. the connection of the composite desk is removable, it can occupy less space when is stored or conveyed. 6. if required, the liner parts can be used as reinforcements.

BRIEF DESCRIPTION OF THE DRAWINGS

The present invention will be further explained with reference to the drawings and embodiments; the present invention will not be restricted by the embodiments.

DETAILED DESCRIPTION OF THE PREFERRED EMBODIMENTS

Embodiment 1

Figure 1:
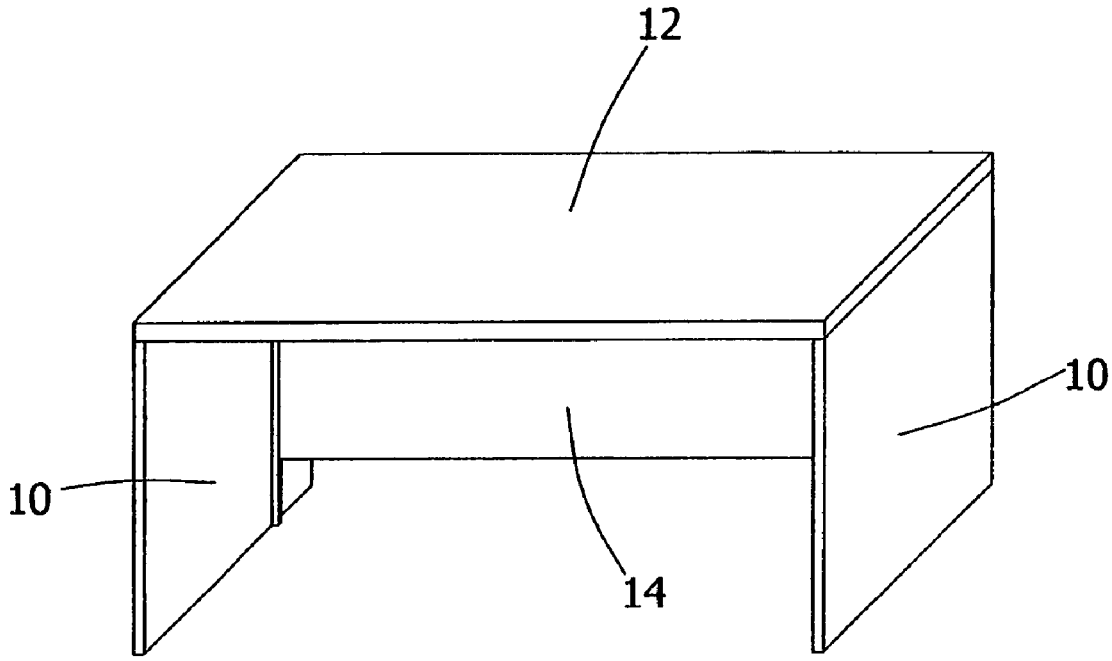
FIG. 1 is the stereogram of the embodiment 1.

A composite desk, referring to FIG. 1, comprising: two desk sideboards 10, a desk top 12, a front baffle 14, the left and right sides of the bottom surface of the desk top 12 are connected to upper ends of two desk sideboards 10 respectively, the left and right sides of the front baffle 14 are connected to the inner surfaces of two desk sideboards 10 respectively. Two desk sideboards 10 support the desk top 12. The connection between the desk top 12 and the desk sideboard 10 is hanging connection; the connection between the front baffle 14 and the desk sideboard 10 is hanging connection; two desk sideboards 10, desk top 12 and the front baffle 14 are made of the plastic composite board.

Figure 2:
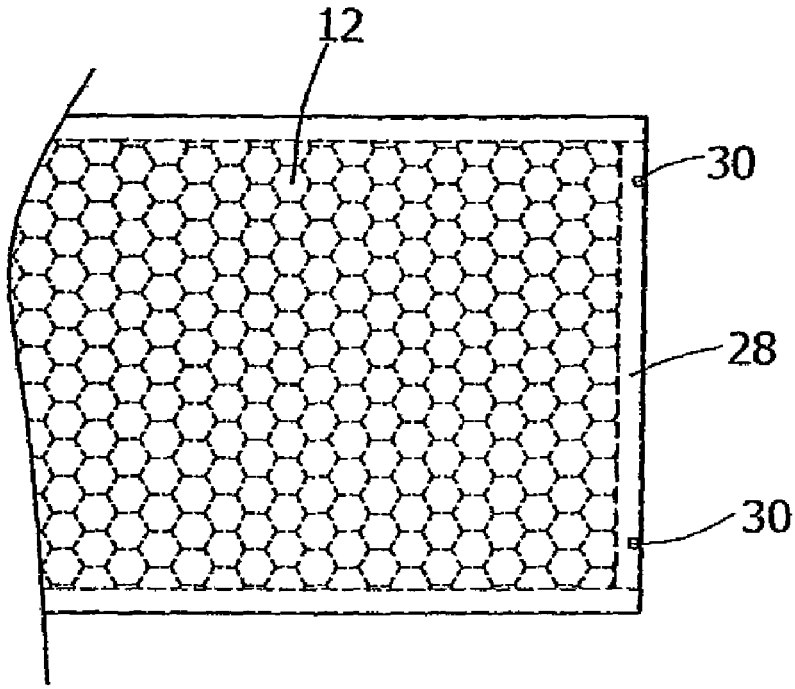
FIG. 2 is the partial bottom view of the desk top of the embodiment 1.

Referring to FIG. 2, the first reinforcements 28 are disposed in left and right sides of the desk top 12 respectively; two first clasp grooves 30 exposed outside the plastic composite board are provided in the first reinforcements 28. The reinforcements 28 are made of tubular material or section material injection moulding material or metal composite.

Figure 3:
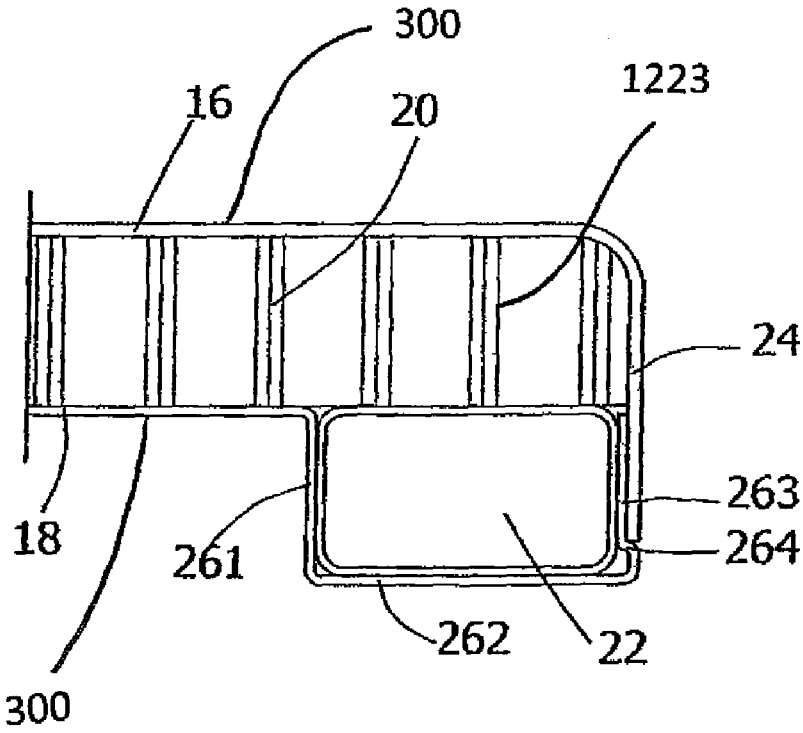
FIG. 3 is the partial sectional view of the plastic composite board of the desk top of the embodiment 1.
Figure 4:
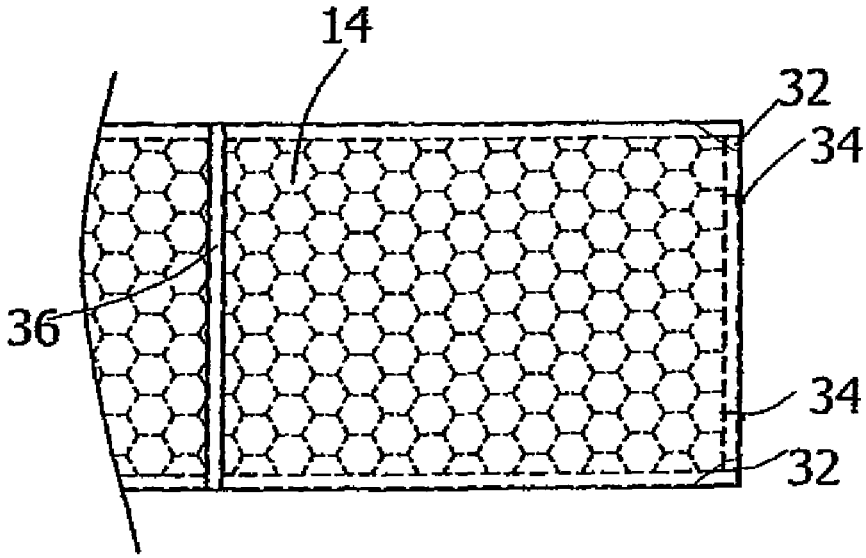
FIG. 4 is the partial bottom view of the front baffle of the embodiment 1.

Referring to FIG. 3, the desk top 12 is made of the plastic composite board, the plastic composite board comprises a first top board 16, a first bottom board 18, a first honeycomb board 20, a first liner part 22, the first honeycomb board 20 is stuffed between the first top board 16 and the first bottom board 18. The first top board 16 and the first bottom board 18 are made of plastic composite board, which is processed by means of vacuum forming technology, the thickness of the plastic composite board is 0.3~4 mm. The edge of the first bottom board 18 extends downwardly, forming the first lower extending portion 261, the lower portion of the first lower extending portion 261 extends laterally, forming the second lower extending portion 262, the outer part of the second lower extending portion 262 extends upwardly, forming the third lower extending portion 263, an extruding portion 264 is formed on the third lower extending portion 263. The edge of the first top board 16 extends downwardly, forming the first upper extending portion 24. The inner side of the first upper extending portion 24 is adjacent to the edge of the first honeycomb board 20 and the portion of the third lower extending portion 263, which is above the extruding portion 264. The first upper extending portion 24 is flush with the lower portion of the third lower extending portion 263. The overlapped layer of the first top board 16 and the first bottom board 18 is located at the bottom of plastic composite boards. The outer surfaces of the first top board 16 and the first bottom board 18 are covered by printing layer, which has timber grain or natural color of marble. The first lower extending portion 261, the second lower extending portion 262 and the third lower extending portion 263 form a groove, the first liner part 22 is fixed in the groove Referring to FIG. 4, the front baffle 14 is made of the plastic composite board, the second reinforcements 32 are respectively disposed in the left and right sides of said plastic composite board. Two first clasps 34 extended out of the plastic composite board are fixed on the second reinforcements 32. The second reinforcement 32 are made of tubular material or section material injection moulding material or metal composite. An auxiliary supporting unit 36 is provided on the bottom surface of the front baffle 14, the auxiliary supporting unit 36 parallels the second reinforcement 32. The first clasp 34 is connected to the second reinforcement 32 by welding.

Figure 5:
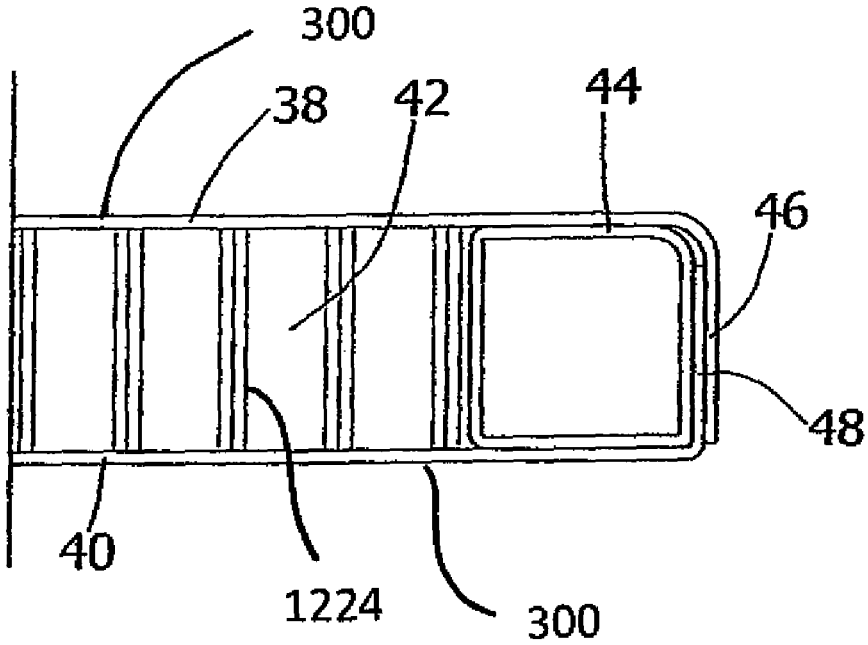
FIG. 5 is the partial sectional view of the plastic composite board of the front baffle of the embodiment 1.

Referring to FIG. 5, the front baffle 14 is made of the plastic composite board, the plastic composite board comprise a second top board 38, a second bottom board 40, a second honeycomb board 42, a second liner part 44, the second honeycomb board 42 is stuffed between the second top board 38 and the second bottom board 40, the liner part 44 is positioned between the second top board 38 and the second bottom board 40, the liner part 44 wraps the second honeycomb board 42 along the sides thereof, the second top board 38 and the second bottom board 40 are made of singlelayer or multiplelayer plastic board, which is processed by means of vacuum forming technology or machining process directly, the thickness of the plastic composite is 0.3.about.4 mm. The edge of the second top board 38 extends downwardly, forming a second upper extending portion 46, the edge of the second bottom board 40 extends upwardly, forming a fourth lower extending portion 48, the inner surface of the second upper extending portion 46 is adjacent to outer surface of the fourth lower extending portion 48, the overlapped layer of the second top board 38 and the second bottom board 40 is located at the side of plastic composite boards. The outer surfaces of the second top board 38 and the second bottom board 40 are covered by printing layer 300 (FIGS. 3 and 5), which has timber grain or natural color of marble.

Figure 6:
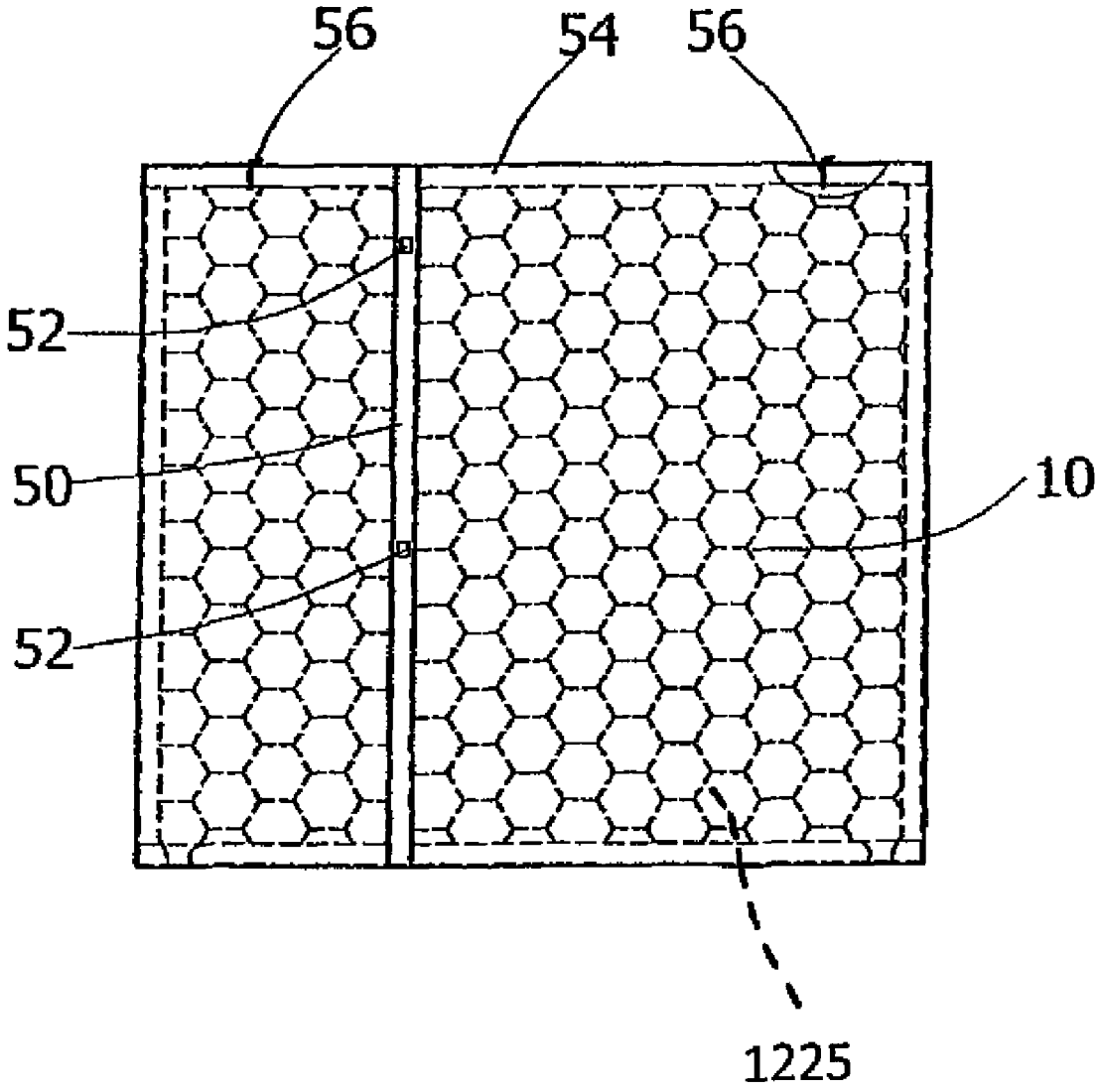
FIG. 6 is the bottom view of the desk sideboard of the embodiment 1.

Referring to FIG. 6, two desk sideboards 10 are made of the plastic composite board, the third reinforcements 50 are respectively and longitudinally disposed at the center of inner side of two plastic composite boards, two second clasp grooves 52 exposed outside the plastic composite board are provided on the third reinforcement 50. The fourth reinforcements 54 are respectively disposed in the upper sides of two plastic composite boards, two second clasps 56 extended out of the plastic composite board are provided on fourth reinforcement 54. The structure of the plastic composite board of the desk sideboard 10 is same to the structure of the plastic composite board of the front baffle 14, so it is unnecessary to describe. The third reinforcements 50 and the fourth reinforcements 54 are made of tubular material or section material injection moulding material or metal composite. The second clasp 56 is connected with the fourth reinforcement 54 by welding.

Two desk sideboards 10, the desk top 12 and the front baffle 14 are made of the plastic composite board, the reinforcement and liner part are positioned between the top board and bottom board, the paper honeycomb core 1224 (FIG. 5) or the plastic honeycomb core 1223 (FIG. 3) or foaming fillers 1225 (FIG. 6) are stuffed between the top board and the bottom board.

Figure 7:
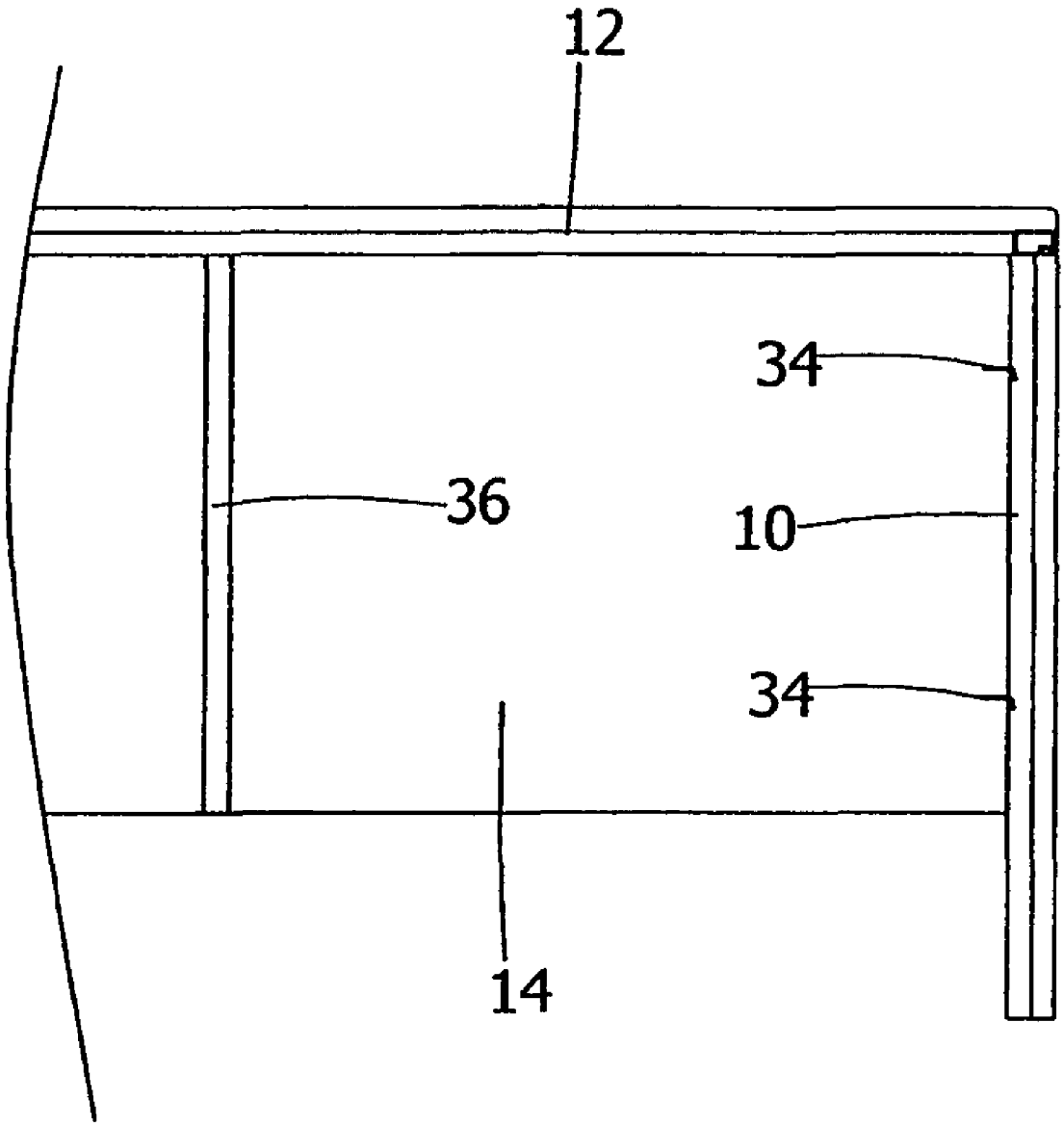
FIG. 7 is the partial elevation view of the embodiment 1.

Referring to FIG. 7, the connection between the desk top 12 and two desk sideboards 10 is realized through the connection between the second clasp 56 and the first clasp groove 30; the connection between the front baffle 14 and the desk sideboard 10 is realized through the connection between the first clasp 34 and the second clasp groove 52.

Figure 8:
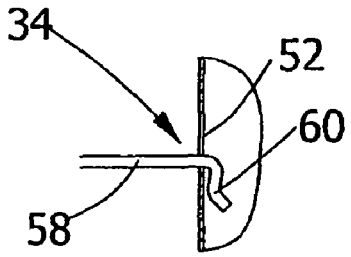
FIG. 8 is the sectional view of the connection between the first clasp and the second clasp groove of the embodiment 1.
Figure 9:
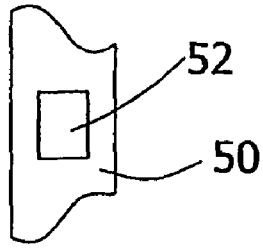
FIG. 9 is the top view of the second clasp groove of the embodiment 1.

Referring to FIG. 8, FIG. 9, the first clasp 34 comprises a connecting stick 58 which is connected with the second reinforcement 32 and a locking stick 60 which is connected with the end of the connecting stick 58, the included angle between the locking stick 60 and the connecting stick 58 is 90°~150°, the shape of the locking stick 60 is S-shaped. The first clasp 34 is connected with the second reinforcement 32 by welding. The second clasp groove 52 is rectangular. The second clasp groove 52 corresponds with the first clasp 34.

The structure of the second clasp 56 is same to the structure of the first clasp 34; the structure of the first clasp groove 30 is same to the structure of the second clasp groove 52.

Embodiment 2

Figure 10:
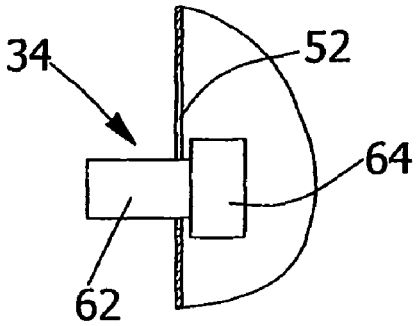
FIG. 10 is the sectional view of the connection between the first clasp and the second clasp groove of the embodiment 2.
Figure 11:
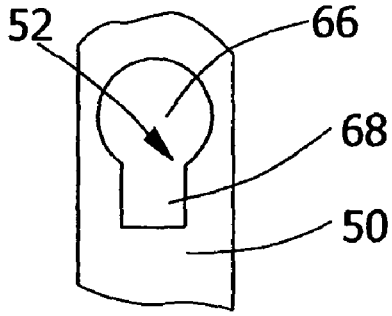
FIG. 11 is the top view of the second clasp groove of the embodiment 2.

The difference between embodiment 2 and embodiment 1 is: Referring to FIG. 10, FIG. 11, the first clasp 34 is a T shaped dowel pin, comprising: a connecting post 62 which is connected with the second reinforcement 32, a locking post 64 which is connected with the end of the connecting post 62, the diameter of the locking post 64 is longer than the diameter of the connecting post 62, the first clasp 34 is connected with the second reinforcement 32 by welding, the second clasp groove is a corresponding T shaped groove, comprising: a circular groove 66, a locking groove 68, whose width is shorter than diameter of the circular groove 66. the diameter of the circular groove 66 is longer than the diameter of the locking post 64, the diameter of the connecting post 62 is less than the width of the locking groove 68.

The structure of the second clasp 56 is same to the structure of the first clasp 34; the structure of the first clasp groove 30 is same to the structure of the second clasp groove 52.

Embodiment 3

Figure 12:
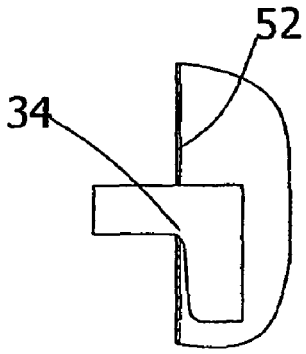
FIG. 12 is the sectional view of the connection between the first clasp and the second clasp groove of the embodiment 3.
Figure 13:
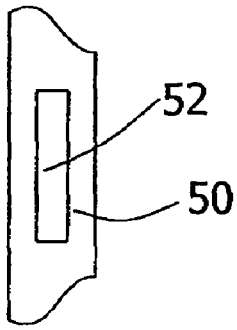
FIG. 13 is the top view of the second clasp groove of the embodiment 3.

The difference between embodiment 3 and embodiment 1 is: Referring to FIG. 12, FIG. 13, the first clasp 34 is L-shaped; the first clasp 34 is connected with the second reinforcement 32 by welding. The second clasp groove 52 is rectangular.

The structure of the second clasp 56 is same to the structure of the first clasp 34; the structure of the first clasp groove 30 is same to the structure of the second clasp groove 52

Embodiment 4

Figure 14:
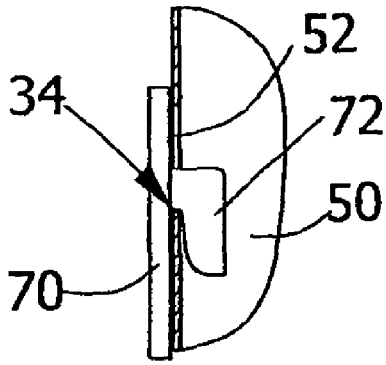
FIG. 14 is the sectional view of the connection between the first clasp and the second clasp groove of the embodiment 4.
Figure 15:
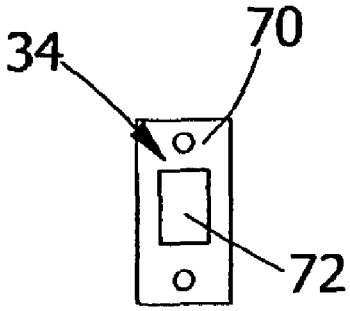
FIG. 15 is the top view of the second clasp of the embodiment 4.
Figure 16:
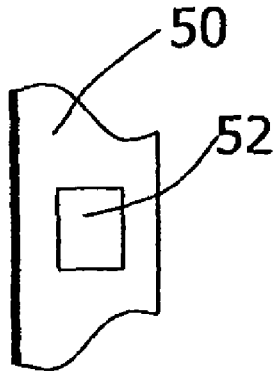
FIG. 16 is the top view of the second clasp groove of the embodiment 4.

The difference between embodiment 4 and embodiment 1 is: Referring to FIG. 14, FIG. 15, FIG. 16, the first clasp 34 is plastic clasp, comprising: a keeper 70 and a hook 72 which is fixed on the keeper 70, the keeper 70 is connected with the second reinforcement 32 through riveted connection; the second clasp groove 52 is rectangular.

The structure of the second clasp 56 is same to the structure of the first clasp 34; the structure of the first clasp groove 30 is same to the structure of the second clasp groove 52

As mentioned above, they are preferred embodiments of the present invention, it does not limit the scope of the present invention. The equivalent change and the modify based on the contents of the technical project and the specification of the present invention, are belong to the scope of the present utility model.

Industrial Applicability

A composite desk of this invention, two desk sideboards and the desk top are entirely or partly made of the plastic composite board; the connection between the desk sideboards and the desk top is hanging connection. The structure is simple and removable, the components thereof can be mass-produced, so the desk has industrial applicability.

The invention claimed is:

1. An easily assemblable desk comprising:

a plurality of panel members, and a plurality of releasable connection members respectively secured to said panel members;

wherein said plurality of panel members includes:

two vertically extending upright support panel members, and a horizontally extending desk top panel member that is supported on top of said upright support panel members and that is releasably secured to said upright support panel members by releasable engagement of respective engageable pairs of said releasable connection members;

wherein at least one of said panel members is a plastic composite panel member comprising:

a lightweight core selected from the group consisting of honeycomb cores and foam cores, a frame element arranged adjoining said core at a peripheral edge of said core, wherein said frame element is an elongate hollow sectional member extending longitudinally along said peripheral edge of said core, and first and second cover sheets arranged on opposite first and second major planar surfaces of said core and on said frame element to cover said core and said frame element, wherein said first cover sheet includes a first sheet portion that extends along an outer peripheral edge of said frame element, wherein said second cover sheet includes a second sheet portion that overlaps on said first sheet portion on said outer peripheral edge of said frame element, and wherein said second sheet portion overlapped on said first sheet portion on said outer peripheral edge of said frame element forms an outwardly-facing outermost peripheral edge of said plastic composite panel member.

2. The easily assemblable desk according to claim 1, wherein said first and second cover sheets are processed by vacuum forming onto said core and said frame element such that said first cover sheet contacts directly on said core and directly on said frame element with said first sheet portion directly in contact on said outer peripheral edge of said frame element.

3. The easily assemblable desk according to claim 1, wherein said frame element is arranged on one of said major planar surfaces of said core at said peripheral edge of said core such that said outer peripheral edge of said frame element is substantially flush with and adjacent to said peripheral edge of said core, and said second sheet portion additionally extends along and covers said peripheral edge of said core.

4. The easily assemblable desk according to claim 3, wherein said plastic composite panel member is said desk top panel member.

5. The easily assemblable desk according to claim 4, wherein another one of said panel members is another said plastic composite panel member, wherein said frame element is arranged on, covering and protruding outwardly away from said peripheral edge of said core of said another plastic composite panel member, and wherein two opposite surfaces of said frame element are respectively substantially flush with said major planar surfaces of said core of said another plastic composite panel member.

6. The easily assemblable desk according to claim 5, wherein said plurality of panel members further include a vertically extending baffle panel member that extends between said upright support panel members to form a top view I-configuration of said baffle panel member and said upright support panel members, and that is releasably secured to said upright support panel members and to said desk top panel member by releasable engagement of additional respective engageable pairs of said releasable connection members; and wherein said baffle panel member is said another plastic composite panel member.

7. The easily assemblable desk according to claim 1, wherein said frame element is arranged on, covering and protruding outwardly away from said peripheral edge of said core, and wherein two opposite surfaces of said frame element are respectively substantially flush with said major planar surfaces of said core.

8. The easily assemblable desk according to claim 1, wherein said cover sheets are respective single-layer or multilayer plastic sheets, plastic boards or plastic composite material sheets.

9. The easily assemblable desk according to claim 1, wherein said engageable pairs of said connection members respectively comprise a groove member and a clasp member that is configured and adapted to releasably engage in said groove member.

10. The easily assemblable desk according to claim 9, wherein said clasp member is L-shaped or T-shaped, and said groove member has a groove that is rectangular, elliptical, T-shaped or keyhole-shaped.

11. An easily assemblable desk comprising:

a plurality of panel members, and a plurality of releasable connection members respectively secured to said panel members;

wherein said plurality of panel members includes:

two vertically extending upright support panel members, and a horizontally extending desk top panel member that is supported on top of said upright support panel members and that is releasably secured to said upright support panel members by releasable engagement of respective engageable pairs of said releasable connection members;

wherein at least one of said panel members is a plastic composite panel member comprising:

a lightweight core selected from the group consisting of honeycomb cores and foam cores, a frame element arranged adjoining said core at a peripheral edge of said core, and first and second cover sheets arranged on opposite first and second major planar surfaces of said core and on said frame element to cover said core and said frame element, wherein said first cover sheet includes a first sheet portion that extends along an outer peripheral edge of said frame element, wherein said second cover sheet includes a second sheet portion that overlaps on said first sheet portion on said outer peripheral edge of said frame element, and wherein said second sheet portion overlapped on said first sheet portion on said outer peripheral edge of said frame element forms an outwardly-facing outermost peripheral edge of said plastic composite panel member, wherein said frame element is arranged on one of said major planar surfaces of said core at said peripheral edge of said core such that said outer peripheral edge of said frame element is substantially flush with and adjacent to said peripheral edge of said core, and said second sheet portion additionally extends along and covers said peripheral edge of said core.

12. The easily assemblable desk according to claim 11, wherein said first and second cover sheets are processed by vacuum forming onto said core and said frame element such that said first cover sheet contacts directly on said core and directly on said frame element with said first sheet portion directly in contact on said outer peripheral edge of said frame element.

13. The easily assemblable desk according to claim 11, wherein said plastic composite panel member is said desk top panel member.

14. The easily assemblable desk according to claim 13, wherein another one of said panel members is another said plastic composite panel member, wherein said frame element is arranged on, covering and protruding outwardly away from said peripheral edge of said core of said another plastic composite panel member, and wherein two opposite surfaces of said frame element are respectively substantially flush with said major planar surfaces of said core of said another plastic composite panel member.

15. The easily assemblable desk according to claim 14, wherein said plurality of panel members further include a vertically extending baffle panel member that extends between said upright support panel members to form a top view I-configuration of said baffle panel member and said upright support panel members, and that is releasably secured to said upright support panel members and to said desk top panel member by releasable engagement of additional respective engageable pairs of said releasable connection members; and wherein said baffle panel member is said another plastic composite panel member.

16. The easily assemblable desk according to claim 11, wherein said cover sheets are respective single-layer or multi-layer plastic sheets, plastic boards or plastic composite material sheets.

17. The easily assemblable desk according to claim 11, wherein said engageable pairs of said connection members respectively comprise a groove member and a clasp member that is configured and adapted to releasably engage in said groove member.

18. The easily assemblable desk according to claim 17, wherein said clasp member is L-shaped or T-shaped, and said groove member has a groove that is rectangular, elliptical, T-shaped or keyhole-shaped.

* * * * *